US006615451B1

(12) United States Patent
Göranson et al.

(10) Patent No.: US 6,615,451 B1
(45) Date of Patent: Sep. 9, 2003

(54) HINGE HAVING A FLEXIBLE STRIP ANCHORED IN A SWITCHABLE MEMBER

(76) Inventors: Dag Göranson, Vikingagatan 11, S-311 32 Falkenberg (SE); Örjan Göranson, Thomas Thorilds väg 3, S-311 40 Falkenberg (SE)

( * ) Notice: Subject to any disclaimer, the term of this patent is extended or adjusted under 35 U.S.C. 154(b) by 0 days.

(21) Appl. No.: 09/831,828

(22) PCT Filed: Nov. 10, 1999

(86) PCT No.: PCT/SE99/02031

§ 371 (c)(1),
(2), (4) Date: May 15, 2001

(87) PCT Pub. No.: WO00/32887

PCT Pub. Date: Jun. 8, 2000

(30) Foreign Application Priority Data

Nov. 16, 1998 (SE) ..... 9803911

(51) Int. Cl.[7] ..... E05D 1/00
(52) U.S. Cl. ..... 16/227; 16/225; 16/321
(58) Field of Search ..... 16/225, 227, 321, 16/335, 336; 160/127, 218, 231.1, 370

(56) References Cited

U.S. PATENT DOCUMENTS 3,822,734 A * 7/1974 Tombu ..... 160/327
3,848,380 A * 11/1974 Assael ..... 160/395
3,928,897 A * 12/1975 Tombu ..... 160/327
4,344,475 A * 8/1982 Frey ..... 16/225
4,765,039 A * 8/1988 Rowlands et al. ..... 160/380
4,777,777 A * 10/1988 Massimo ..... 16/225
4,817,699 A * 4/1989 Fein ..... 160/327
5,148,850 A * 9/1992 Urbanick ..... 16/225
5,367,744 A * 11/1994 Ahlberg et al. ..... 16/227
5,448,799 A * 9/1995 Stein, Jr. ..... 16/225
5,732,757 A * 3/1998 Mariol ..... 16/225
6,324,797 B1 * 12/2001 Fago et al. ..... 160/327

* cited by examiner

*Primary Examiner*—Gary S. Hartmann

(57) ABSTRACT

An apparatus for pivotally connecting two parts. A profile member (2) is switchable from an open position to a closed position and is secured to the first part. A strip (1), formed of a flexible material, is secured to the second part and extends into the profile member (2) so as to be anchored in the profile member (2) after switching of the profile member (2) from the open position to the closed position. Two profile members can be used, one secured to each part, with the flexible strip extending between the profile members (2) and adapted to be anchored in the two profile members (2) after switching of the two profile members (2) from their open positions to their closed positions.

12 Claims, 6 Drawing Sheets

HINGE HAVING A FLEXIBLE STRIP ANCHORED IN A SWITCHABLE MEMBER

FIELD OF THE INVENTION

The present invention relates to an arrangement for forming a pivot between a number of parts, of which at least the one part is to be pivotal in relation to the other.

BACKGROUND OF THE INVENTION

Prior art pivot constructions of the above-mentioned so-called folding pivot type have proved to suffer from various drawbacks, such as high production costs, because of difficulties in maintaining sufficient and acceptable tolerances, which in turn has resulted in a large number of rejects. Further, prior art constructions have proved to suffer from assembly problems, as well as difficulties in maintaining acceptable criteria in respect of appearance and good mechanical strength. For both reasons of cost and reasons of assembly engineering, it is desirable that the number of parts should be as few as possible. In the case when folding pivot constructions are employed for providing folding walls, screens etc., it is of the utmost importance that the construction satisfy stringent demands on aesthetic and functional appearance. Furthermore, such constructions must be easy to keep clean, in particular if they are employed in the nursing and medical care environments. cl SUMMARY The task forming the basis of the present invention is to provide a design and construction which constitute an improvement to the state of the art prevailing in this area.

The task is solved according to the present invention in that a profile member which is switchable from n open position to a closed position is secured on one part and a strip of a flexible material is secured on the other part and in the profile member in its closed position. In the event at least two parts are to be pivotal in relation to one another, each one of the parts is provided with such a profile member which is switchable from an open position to a closed position, and the strip of flexible material is secured in both profile members when these are in their closed position. The strip consists of a fabric-reinforced plastic material of relatively slight thickness in relation to other dimensions. The profile member has a number of anchorage devices for engagement with the strip in the closed position of the profile member. The profile member has two shanks which are substantially mutually at right angles and of which the first supports, via a folding indentation, an arched shank whose opposite edge in relation to the folding indentcation is adjacent the free edge of the second right-angled shank in the closed position of the profile member. The free mutually adjacent edges each display one of the anchorage devices. The arched shank has an inwardly directed leg shank with a snap foot for cooperation with a snap device on the above-mentioned second right-angled shank for retaining the profile member in the closed position with the strip clamped between the anchorage devices and the snap devices. The opposite side or the snap foot heel in relation to the snap foot is designed for cooperation with a flange on the inside of the above-mentioned first right-angled shank for locking the profile member in the closed position with the aid of a locking pin between the snap foot heel and the flange.

As a result of the present invention, the folding pivot construction will be extremely simple to manufacture and assemble. The profile member included in the construction is easy to extrude in a suitable material and, after inlay of the pivot strip proper, to switch the profile member from the open position to the closed position, in which the strip is anchored in the profile member, whereafter the free portion of the pivot strip may be anchored in some other part or in another profile member. In the event that the pivot strip is to be disposed between two profile members, it is simple, in a machine according to the present invention for assembling the pivot joint construction, to execute the extrusion operation of both the profile members simultaneously after placing of the pivot strip between them. With the aid of a pivot construction according to the present invention, it is easy to build, for instance, a folding screen for employment in different screening contexts, for example exhibition halls, open plan offices, medical care facilities and the like. In such an event, a double folding pivot construction is placed between a number of panels of suitable material. The pivot constructions are fixed to the panels with the aid of screws or pins which extend into the ends of the pivot constructions and then simultaneously fix or lock the profile members in the closed position. In this case, the anchorage of the pivot strip in each respective profile member is also secured. As a result of the present invention, the pivot construction will be extremely smooth, but moreover quiet and tightly abutting, with the result that there is no risk of seeing through.

BRIEF DESCRIPTION OF THE DRAWINGS

The present invention will be described in greater detail below with reference to the accompanying Drawings.

DETAILED DESCRIPTION

Figure 1:
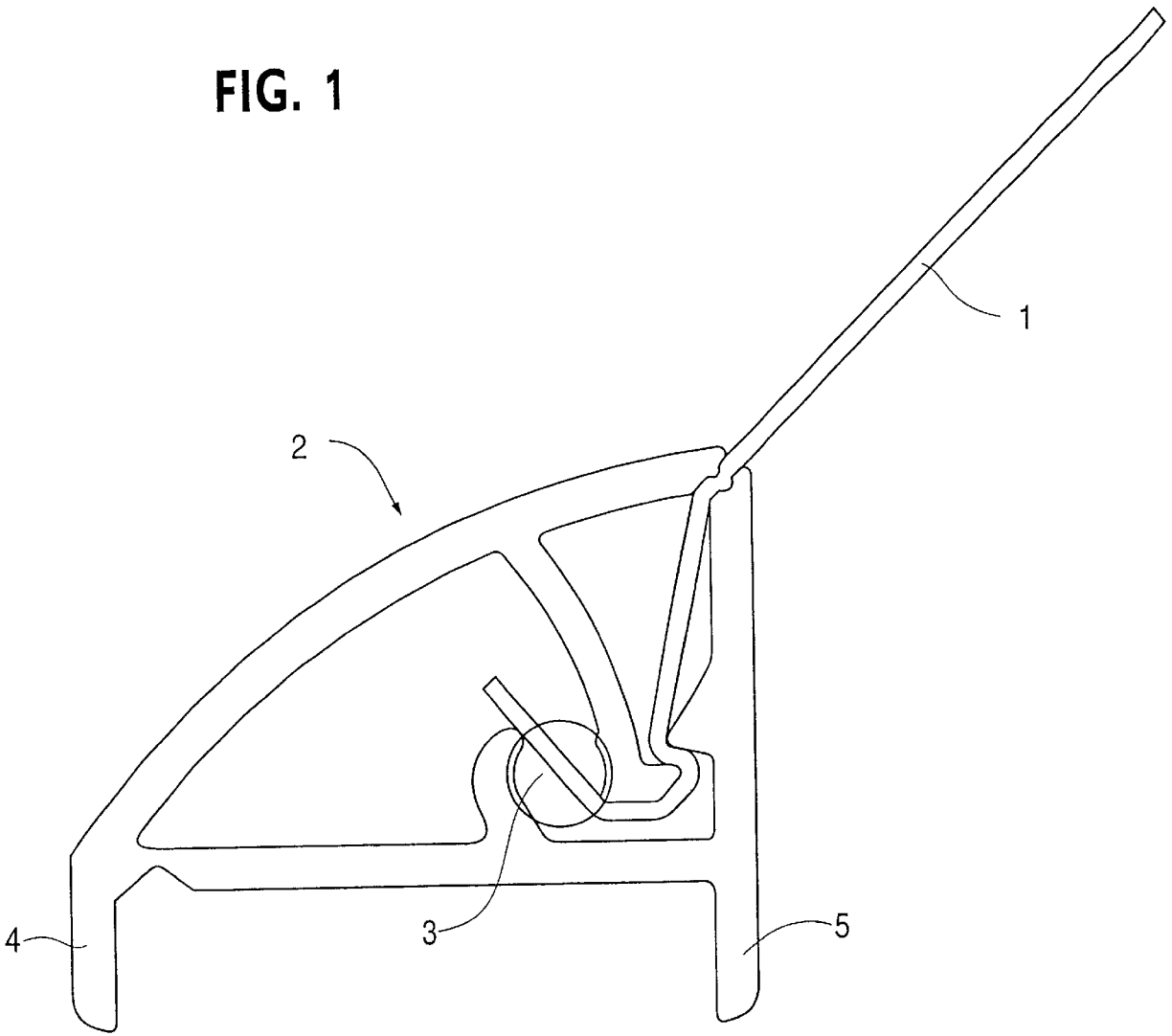
FIG. 1 shows a cross section through a profile member according to one embodiment of the present invention with a pivot strip therein.

FIG. 1 shows one embodiment of a pivot construction according to the present invention. This pivot construction has a pivot strip 1 and a profile member 2. The profile member 2 is shown in the closed position, in which the pivot strip 1 is anchored in the profile member 2. The profile member 2 is lockable in the illustrated, closed position by placing a locking pin or a locking screw (not shown, but positioned within circle 3 in FIG. 1). The pivot construction in FIG. 1 is intended to be placed between two parts, of which at least one is to be pivotal in relation to the other. The free portion of the pivot strip 1 may be anchored on the first part, while the profile member 2 is secured on the other part, which may advantageously consist of a panel or the like which is placed between the flanges 4 and 5 on the profile member 2. The pivot strip 1 may be manufactured from numerous materials, but one material which is preferred is a fabric-reinforced plastic sheeting material. One of the more important properties of the material must be its bending capability or flexibility in the portion at least in the proximity of the profile member 2. This portion of the pivot strip 1 must, moreover, display considerable durability and resistance to a large number of bendings. The profile member 2 is advantageously manufactured from an extruded aluminium material which, moreover, may be provided with a suitable surface coating for achieving the desired colour and colour shade.

Figure 3:
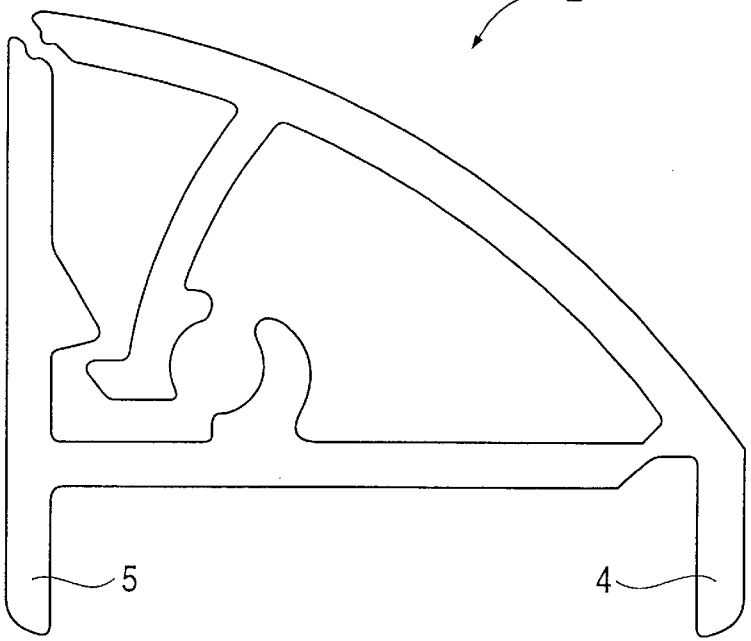
FIG. 3 shows a similar cross section to that of FIG. 2 in the closed position.
Figure 2:
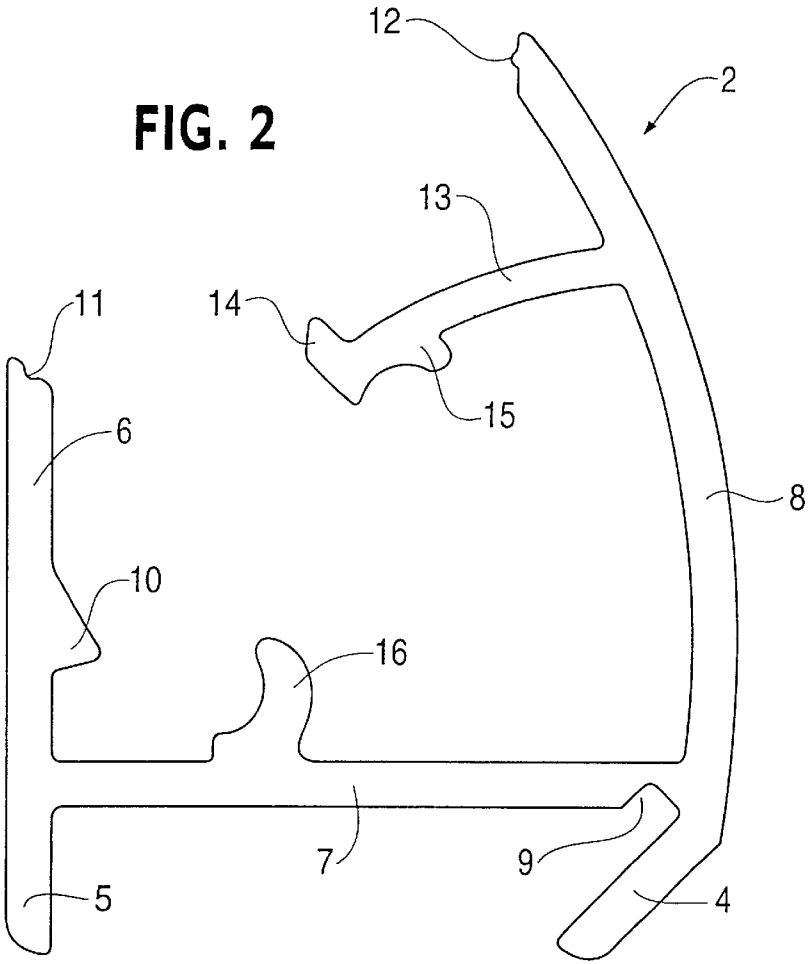
FIG. 2 shows a similar cross section to that of FIG. 1 of the profile member in the open position.

In FIGS. 2 and 3, the profile member 2 is shown partly in the open position and partly in the closed position. As was mentioned above, the profile member 2 is advantageously manufactured by the extrusion of a suitable material with the parts in the open position illustrated in FIG. 2. The profile member 2 has a shank 6 which is substantially at right angles to a shank 7 as well as an arched shank 8 which, via a folding indentation 9, is connected to the shank 7. On the inside of the shank 6, a snap device 10 is provided in the form of a longitudinal bight. The free edge of the shank 6 is provided with a longitudinal depression 11 for cooperation with a longitudinal projection 12 on the free end of the arched shank 8.

The arched shank 8 further supports an inwardly directed leg shank 13 which has a foot 14 for cooperation with the snap device 10 on the shank 6 and a heel portion 15 for cooperation with a substantially complementarily designed flange 16 on the inside of the shank 7. The placing of a pin or a screw between the heel portion 15 and the flange 16 will entail an efficient locking of the profile member 2 in the closed position illustrated in FIG. 3.

Figure 4:
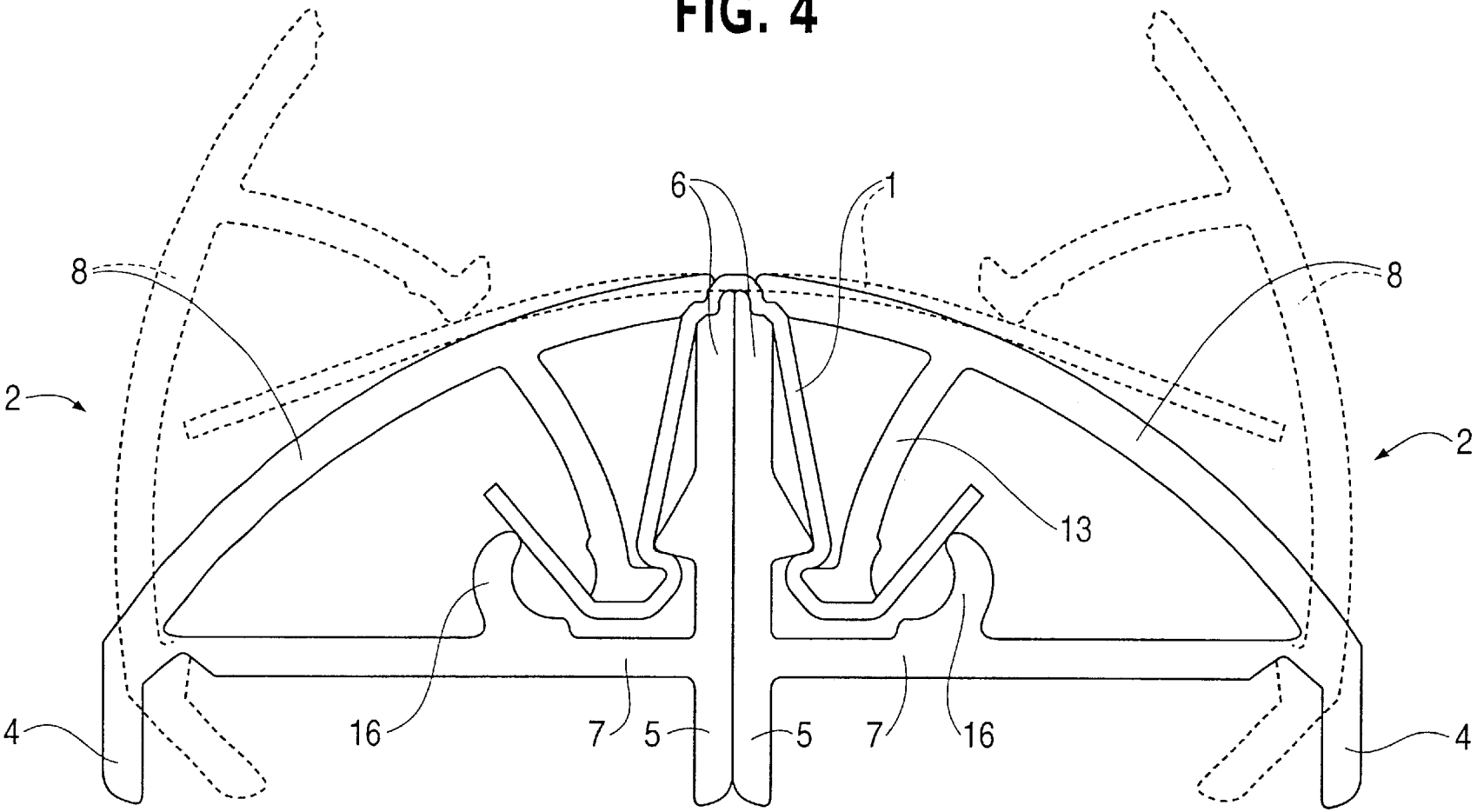
FIG. 4 shows a substantially similar cross section to that of FIG. 3 but with an additional profile member, in which the pivot strip is anchored, the profile members and the pivot strip being shown in different positions.

In the event that it is desirable to have one profile member 2 on each side of the pivot strip 1, the profile members 2 are placed in accordance with FIG. 4, with the shanks 6 towards one another and with the pivot strip 1 placed in accordance with the dot-dashed broken lines. The arched shanks 8 on the profile members 2 are shown by dashed broken lines in the open position. In the closed position, the various parts are shown by solid lines. The pivot strip 1 will thus be bent over the edge of the shanks 6 down past the snap devices 10 via the foot 14 and the heel portion 15 in order to rest against the tip of the flange 16 in the event that the pivot strip 1 is so wide that it extends right up to the flange 16.

Figure 5:
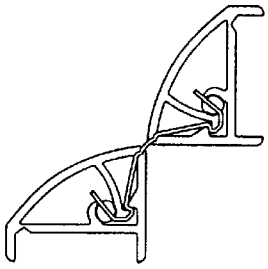
FIG. 5 shows a cross section of the pivot construction of FIG. 4 with possible parts at right angled position.
Figure 6:
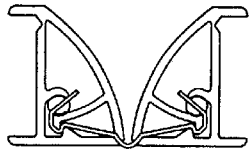
FIG. 6 shows a similar cross section with the parts aligned with each other.

In FIGS. 5 and 6, the pivot construction illustrated in FIG. 4 is shown in two different positions. In FIG. 5, the pivot construction is shown with the parts on which the profile members 2 are secured at right angles to each other. In FIG. 6, the parts on which the profile members 2 are secured are shown aligned with each other.

Figure 7:
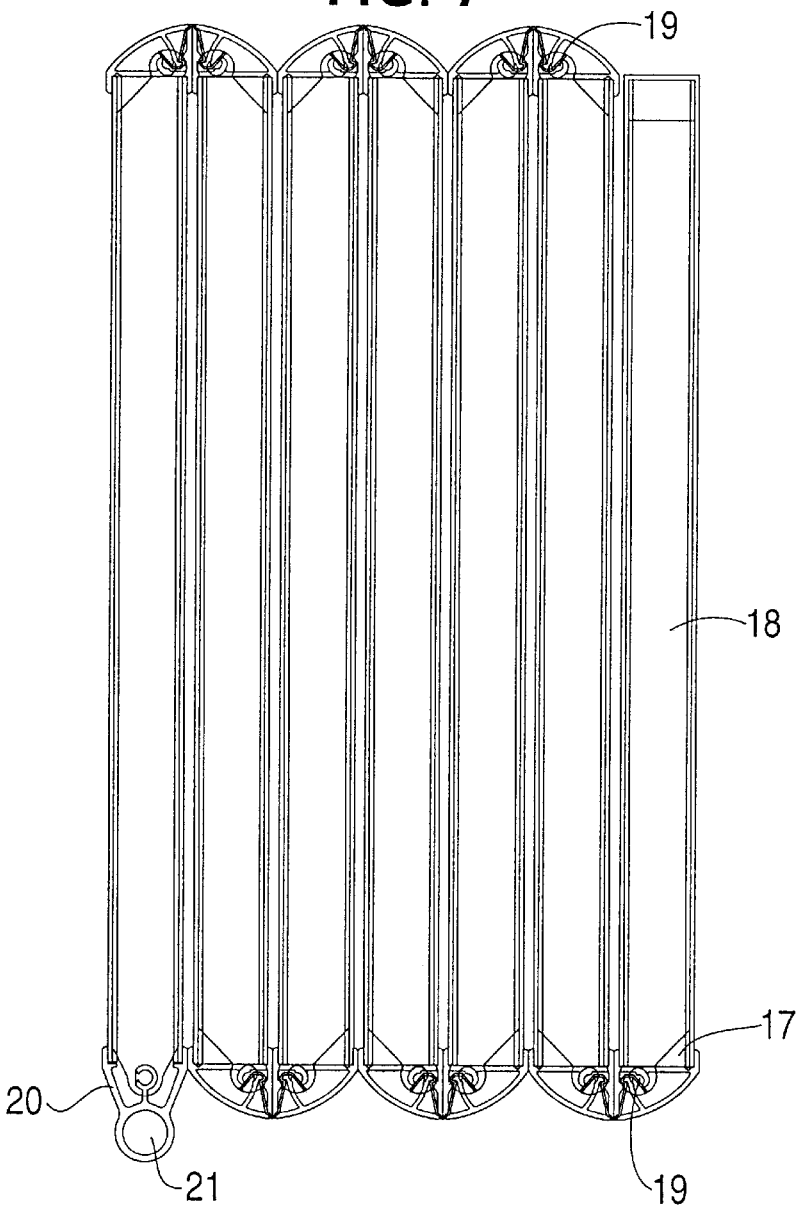
FIG. 7 shows a cross section through a part of a folding wall or folding screen with pivot constructions according to the present invention, and according to FIGS. 4–6.

In FIG. 7, an application of the pivot construction according to the present invention is exemplified and, in accordance with the foregoing description for providing a folding wall or a folding screen with seven substantially identical panels which may be provided, on each edge, with a profile member 2 which are pairwise interconnected by means of a pivot strip 1. For reasons of clarity, the pivot strips are not shown in FIG. 7. The profile members 2 are kept in place partly with the aid of the flanges 4 and 5 and partly with the aid of a rod 18 extending along the end edge of the panels 17 and secured in the profile members with the aid of a locking pin or a screw 19. The screen wall in FIG. 7 is secured to a wall or a frame with the aid of an end section 20 which is advantageously pivotal on a rod or a shaft 21 which in turn is secured on a frame or a wall.

Figure 9:
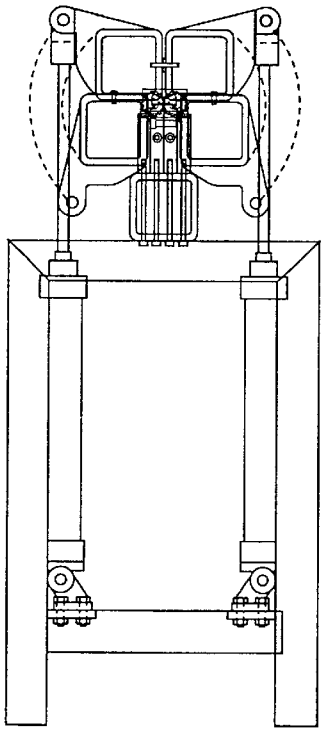
FIG. 9 is an end elevation of the machine of FIG. 8.
Figure 8:
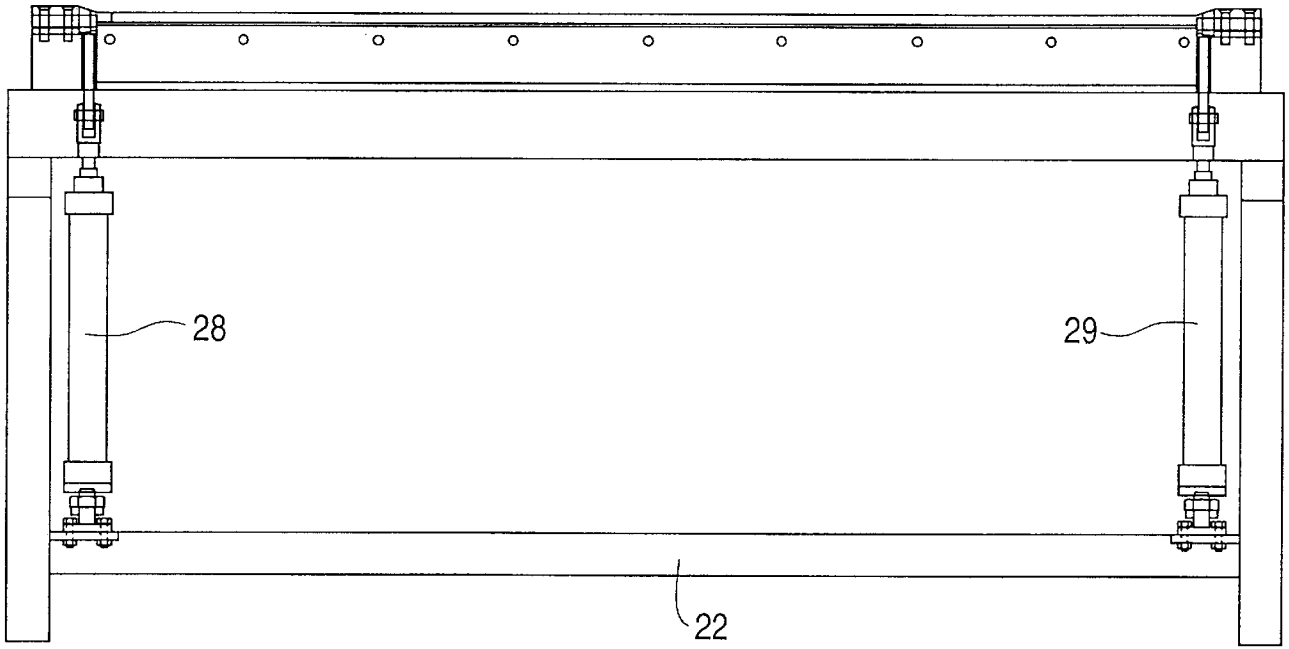
FIG. 8 shows a front elevation of a machine for switching the profile members with the pivot strip from the open position to the closed position.
Figure 10:
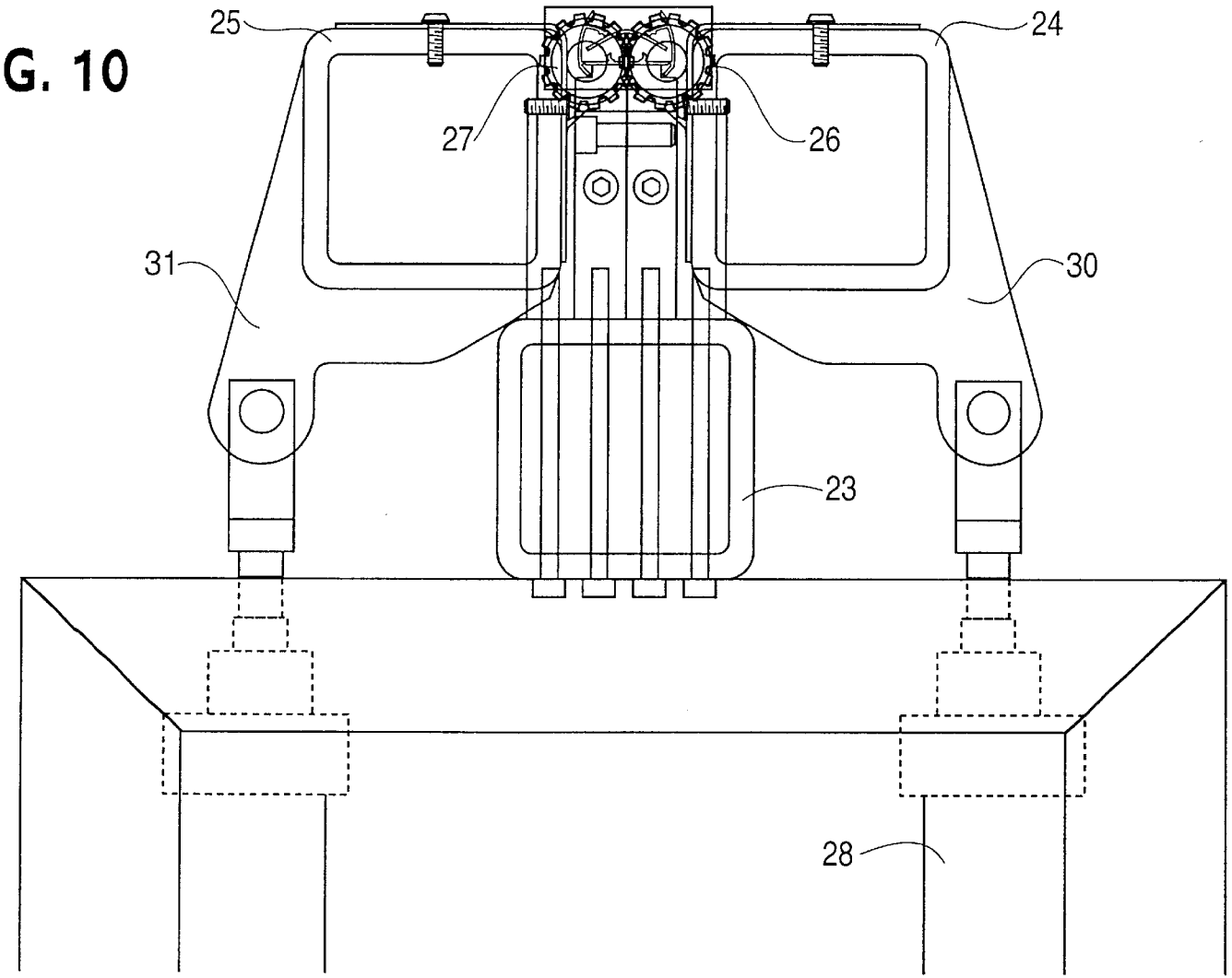
FIG. 10 shows, on a larger scale, a part of the end elevation illustrated in FIG. 9.

FIGS. 8–10 show a machine for switching the profile members 2 with the pivot strip 1 from the open position illustrated in FIG. 2 to the closed position illustrated in FIG. 3. The machine in FIGS. 8–9 has a frame 22 which supports a table 23 on whose upper face are placed two profile members 2 with a pivot strip 1 extending between them in substantially the same manner as illustrated in FIG. 4. The flanges 5 fit in a groove in the table, while the flanges 4 are located outside the table top, whereby the shank 7 will rest on the table top. The groove for the flanges 5 is slightly wider than the flanges in order to permit the placing of an interlay or a spacer between the flanges 4 for adjusting the rigidity in the joint. The thicker the interlay or spacer, the smoother will be the joint. In one embodiment, an interlay of a thickness of 0.6 mm has proved to give a moderately smooth pivoting. On each side of the table 23 there extend square tubes 24 and 25. These square tubes 24 and 25 are each provided with a toothed wheel 26 and 27, respectively. The toothed wheels are journalled on end pieces and define the pivot axes of the square tubes 24 and 25. The square tubes 24, 25 are pivotal by means of cylinders 28, 29. The square tubes 24, 25 thus have a cylinder at each end, and the piston rods of the cylinders are pivotally secured on end plates 30 and 31 on the square tubes 24 and 25. On protraction of the pistons, the square tubes 24 and 25 will be pivoted about the toothed wheels 26 and 27, and the square tubes will come into contact with the arched shanks 8 substantially flush with the leg shanks 13 and switch the arched shanks from the open position illustrated by dashed lines in FIG. 4 to the closed position illustrated by solid lines in FIG. 4. At an early stage, the foot 14 comes into frictional contact with the pivot strip 1 and the friction between the foot 14 and the pivot strip 1 will cause stretching of the pivot strip 1. The friction and the stretching will be greater and greater the closer the parts come to the closed position. Thereby, an extraordinary evenness in the pivot joint will be ensured. With the aid of the machine shown in FIGS. 8–10, it is thus simple to provide a pivot construction according to the present invention which thereafter may simply be applied on panels 17 in accordance with FIG. 7 and be fixed on the panels 17 with the aid of cross stays 18 and locking screws 19.

The present invention is, naturally, not restricted to the embodiment described in the foregoing. Many modifications being of course possible without departing from the inventive concept as defined in the appended claims.

What is claimed is:

1. Apparatus for pivotally connecting two parts, comprising:

a strip (1) formed of a flexible material and having a first end adapted to be secured to a first one of the parts and having a second end; and a profile member (2) adapted to be secured to a second one of the parts and having a foot portion (14), a heel portion (15), a snap device (10), and a flange (16), the profile member (2) switchable between an open position in which the foot portion (14) and the snap device (10) are spaced from each other and the heel portion (15) and the flange (16) are spaced from each other, permitting insertion of the strip second end between the foot portion (14) and the snap device (10) and between the heel portion (15) and the flange (16), and a closed position in which the strip second end is frictionally engaged between the foot portion (14) and the snap device (10) and between the heel portion (15) and the flange (16) to anchor the strip second end within the profile member (2).

2. The apparatus claimed in claim 1, wherein the strip (1) is made of a fabric-reinforced plastic material of relatively slight thickness in relation to other dimensions.

3. The apparatus claimed in claim 1, wherein the profile member (2) has two shanks (6, 7) positioned substantially at right angles with one another, a first one of the right-angled shanks (7) having a fold indentation (9) and supporting an arched shank (8), the arched shank (8) having a free edge (12) opposite the fold indentation (9) and adjacent a free edge (11) of a second one of the right-angled shanks (6) in the closed position of the profile member (2).

4. The apparatus as claimed in claim 3, wherein the free edges of the arched shank (8) and the second one of the right-angle shanks (6) each has an anchorage device (11, 12).

5. The apparatus claimed in claim 4, wherein the arched shank (8) includes an inwardly directed leg shank portion (13) with the foot portion (14) thereon, and the second right-angled shank (6) has the snap device (10) thereon.

6. The apparatus claimed in claim 3, further comprising a locking pin adapted to cooperate with the flange (16) and the heel portion (15) to lock the profile member (2) in the closed position.

7. Apparatus for pivotally connecting first and second parts, comprising:

a strip (1) formed of a flexible material and having first and second ends;

first and second profile members (2) adapted to be secured to the first and second parts, respectively, each profile member (2) having a foot portion (14), a heel portion (15), a snap device (10), and a flange (16), each profile member (2) switchable between an open position in which the foot portion (14) and the snap device (10) are spaced from each other and the heel portion (15) and the flange (16) are spaced from each other, permitting insertion of a respective one of the strip ends between the foot portion (14) and the snap device (10) and between the heel portion (15) and the flange (16), and a closed position in which said one of the strip ends is frictionally engaged between the foot portion (14) and the snap device (10) and between the heel portion (15) and the flange (16) to anchor the strip first and second ends within the first and second profile members (2) respectively.

8. The apparatus claimed in claim 7, wherein each profile member (2) has two shanks (6, 7) positioned substantially at right angles with one another, a first one of the right-angled shanks (7) having a fold indentation (9) and supporting an arched shank (8), the arched shank (8) having a free edge (12) opposite the fold indentation (9) and adjacent a free edge (1 1) of a second one of the right-angled shanks (6) in the closed position of each profile member (2).

9. The apparatus as claimed in claim 8, wherein in each profile member the free edges of the arched shank (8) and the second one of the right-angle shanks (6) each has an anchorage device (11, 12).

10. The apparatus claimed in claim 9, wherein in each profile member the arched shank (8) includes an inwardly directed leg shank portion (13) with the foot portion (14) thereon, and the second right-angled shank (6) has the snap device (10) thereon.

11. The apparatus of claim 8, further comprising two locking pins, each locking pin adapted to cooperate with the flange (16) and the heel portion (15) of a respective one of the profile members to lock said respective one of the profile members in the closed position.

12. The apparatus claimed in claim 7, wherein the strip (1) is made of a fabric-reinforced plastic material of relatively slight thickness in relation to other dimensions.

* * * * *